US007355554B2

(12) United States Patent
Boisbouvier et al.

(10) Patent No.: US 7,355,554 B2
(45) Date of Patent: Apr. 8, 2008

(54) METHOD OF PRODUCING A PHOTONIC BANDGAP STRUCTURE ON A MICROWAVE DEVICE AND SLOT TYPE ANTENNAS EMPLOYING SUCH A STRUCTURE

(75) Inventors: Nicolas Boisbouvier, Rennes (FR); Françoise Le Bolzer, Rennes (FR); Ali Louzir, Rennes (FR); Anne-Claude Tarot, Etrelles (FR); Kouroch Mahdjoubi, Cesson (FR)

(73) Assignee: Thomson Licensing, Boulogne Billancourt (FR)

( * ) Notice: Subject to any disclaimer, the term of this patent is extended or adjusted under 35 U.S.C. 154(b) by 0 days.

(21) Appl. No.: 10/530,336

(22) PCT Filed: Oct. 3, 2003

(86) PCT No.: PCT/FR03/50080

§ 371 (c)(1),
(2), (4) Date: Nov. 10, 2006

(87) PCT Pub. No.: WO2004/034502

PCT Pub. Date: Apr. 22, 2004

(65) Prior Publication Data

US 2007/0097005 A1 May 3, 2007

(30) Foreign Application Priority Data

Oct. 11, 2002 (FR) ..... 02 12656

(51) Int. Cl.
*H01Q 13/10* (2006.01)

(52) U.S. Cl. ..... 343/767; 343/909

(58) Field of Classification Search ..... 343/767, 343/769, 770, 909

See application file for complete search history.

(56) References Cited

U.S. PATENT DOCUMENTS

| | | | | |
|---|---|---|---|---|
| 5,081,466 | A * | 1/1992 | Bitter, Jr. | 343/767 |
| 5,519,408 | A * | 5/1996 | Schnetzer | 343/767 |
| 5,748,152 | A * | 5/1998 | Glabe et al. | 343/767 |
| 6,518,930 | B2 * | 2/2003 | Itoh et al. | 343/767 |
| 7,071,889 | B2 * | 7/2006 | McKinzie et al. | 343/756 |

FOREIGN PATENT DOCUMENTS

WO WO 01/95434 12/2001

OTHER PUBLICATIONS

T.J. Ellis et al, Institute of Electrical and Electronics Engineers: "MM-Wave Tapered Slot Antennas on Micromachined Photonic Bandgap Dielectrics", 1996 ieee mtt-s International Microwave Symposium Digest. San Francisco, Jun. 17-21, 1996, IEEE MTT-S Int'l Microwave Symposium Digest, New York, IEEE, US, vol. 2, Jun. 17, 1996, pp. 1157-1160.

(Continued)

*Primary Examiner*—Tan Ho
(74) *Attorney, Agent, or Firm*—Joseph J. Laks; Robert D. Shedd; Brian J. Cromarty

(57) ABSTRACT

The invention relates to a method of producing a photonic bandgap structure on a slot-type microwave device which is produced on a metallized substrate. According to the invention, periodically-spaced patterns are formed on the surface of the aforementioned substrate opposite the surface comprising the slot. The invention is suitable for slot-type antennas.

14 Claims, 8 Drawing Sheets

OTHER PUBLICATIONS

J.D. Shumpert et al. "Parallel-Plate Mode Reduction in Conductor-Backed Slots Using Electromagnetic Bandgap Substrates" IEEE Transactions on Microwave Theory and Techniques, IEEE Inc., New York, US, vol. 47, No. 11, Nov. 1999, pp. 2099-2103.

W.Y. Leung et al. "Slot Antennas on Photonic Band Gap Crystals" IEEE Transactions on Antennas and Propagation, IEEE Inc., New York, US, vol. 45, No. 10, Oct. 1, 1997, pp. 1569-1570.

V. radiasic et al. Novel 2-D Photonic Bandgap Structure for Microstrip Lines IEEE Microwave and Guided Wave Letters, IEEE Inc., New York, US, vol. 8, No. 2, Feb. 1, 1998, pp. 69-71.

Yun Tae-Yeoul et al. "One-Dimensional photonic bandgap resonator and varactor tuned resonators" Microwave Symposium Digest, 1999 IEEE MTT-S Int'l Anaheim, CA, US, Jun. 13-19, 1999, Piscataway, NJ USA, IEEE, US Jun. 13, 1999, pp. 1629 and 1632.

Search Report Dated May 18, 2004.

* cited by examiner

METHOD OF PRODUCING A PHOTONIC BANDGAP STRUCTURE ON A MICROWAVE DEVICE AND SLOT TYPE ANTENNAS EMPLOYING SUCH A STRUCTURE

This application claims the benefit, under 35 U.S.C. § 365 of International Application PCT/FR03/50080, filed Oct. 3, 2003, which was published in accordance with PCT Article 21(2) on Jul. 10, 2003 in French and which claims the benefit of French patent application No. 0212656, filed Oct. 11, 2002.

The present invention relates to a method of producing a photonic bandgap structure on a microwave device, more particularly on a device of the slot type produced on a metallized substrate. The present invention also relates to slot-type antennas using such a structure.

BACKGROUND OF THE INVENTION

Photonic bandgap structures, known as PBG structures, are periodic structures that prevent the propagation of a wave for certain frequency bands. These structures were firstly used in the optical field but, in recent years, their application has been extended to other frequency ranges. Thus, they are used in particular in microwave devices such as antennas, filters, waveguides, etc. The use of a photonic bandgap structure with a line produced in microstrip technology is described for example in the article "Novel 2-D photonic band gap structure for microstrip lines" published in the journal IEEE Microwave and Guided Wave Letters, Vol. 8, No. 2, Febuary 1998. This article describes a photonic bandgap structure consisting of discs etched on the opposite side of the substrate to that receiving the microstrip line. This structure allows a filter to be produced.

In the case of microstrip lines or patch-type antennas, the PBG structures are mainly obtained either by etching periodic patterns, obtained by demetallizing the earth plane of the structure produced in microstrip technology as described above, or by periodically drilling the substrate comprising the circuits in microstrip technology while still maintaining the continuity of the earth plane. The structures already described in the prior art offer many possibilities, especially for filtering.

SUMMARY OF THE INVENTION

The present invention therefore proposes a method of producing a novel photonic bandgap structure on a microwave device and its application in antennas, especially annular slot antennas or Vivaldi antennas, for frequency matching or filtering of the said antenna.

Thus, the subject of the present invention is a method of producing a photonic bandgap (PBG) structure on a slot-type microwave device produced on a metallized substrate, characterized in that it consists in forming periodically spaced metal patterns on the opposite side of the substrate from that receiving the slot.

According to an additional characteristic, the periodicity between two patterns is equal to $k\lambda g/2$ where $\lambda g$ is the wavelength of the wave guided in the slot at the chosen bandgap frequency and k is an odd integer. Moreover, the width and the depth of the bandgap depend on the area of the periodic pattern. Thus, a periodic pattern may take the form of a disc, a square or a ring, or may consist of elements having the shape of an H or any other known shape that can be periodically repeated, the surface area of which will determine the width and the depth of the bandgap. According to the invention, the periodic patterns may be different patterns having the same equivalent area, namely, for a pattern in the form of a disc, the ratio r/a, where r is the radius of a pattern and a is the distance between two patterns, is identical over the entire length of the structure.

Preferably, the periodic patterns are produced by etching a metal layer deposited on the opposite side of the substrate from that receiving the slot. The periodic structures are at least partly produced beneath the slot.

Moreover, the present invention also relates to microwave antennas in which a PBG structure is formed in order to filter out certain undesirable frequencies or to obtain several communication bands by opening forbidden bands in the frequency response of a very broadband antenna. This type of antenna is particularly useful in the field of wireless telecommunications.

The subject of the present invention is therefore also a microwave antenna formed by a closed slot produced on a metallized substrate, the slot being fed via a feed line, characterized in that it includes, beneath the closed slot, a bandgap structure produced according to the method described above. In one embodiment, the periodicity of the patterns of the PBG structure is chosen so that the bandgap frequency is equal to one of the harmonics of the operating frequency of the closed slot.

In another embodiment, the periodicity of the patterns of the PBG structure is chosen so that the bandgap frequency is greater than the operating frequency of the closed slot. In this case, the structure is used within its bandwidth, thereby making the circuits using slots more compact.

Preferably, the closed slot is an annular slot. The slot is fed at a slot-line transition via a feed line produced in microstrip technology.

According to an additional characteristic of the invention, a photonic bandgap structure is produced, beneath the microstrip line, by demetallizing the opposite surface of the substrate from that on which the microstrip line is produced.

According to yet another characteristic of the present invention, this applies to a Vivaldi slot antenna characterized in that it includes a photonic bandgap structure produced according to the method described above. In this case, the bandgap structure is produced along at least one of the profiles of the slot forming the Vivaldi antenna.

BRIEF DESCRIPTION OF THE DRAWINGS

Preferably, the Vivaldi antenna is fed at a slot-line transition via a feed line produced in microstrip technology. It is then possible to increase the number of bandgaps, either by adding, beneath the microstrip line, a photonic bandgap structure by demetallizing that surface of the substrate which receives the line, or by having two separate photonic bandgap structures, one on the first profile of the Vivaldi antenna, corresponding to a first forbidden frequency band, and the other on the other profile of the Vivaldi antenna, corresponding to a second forbidden frequency band.

Other characteristics and advantages of the present invention will appear on reading the description of the various embodiments, this description being given with reference to the drawings appended hereto, in which.

DESCRIPTION OF PREFERRED EMBODIMENTS

To simplify the description, identical elements bear the same reference numbers in the figures.

The method of producing a photonic bandgap or PBG structure on a slot-type microwave device will firstly be described with reference to FIGS. 1 to 7.

Figure 1:
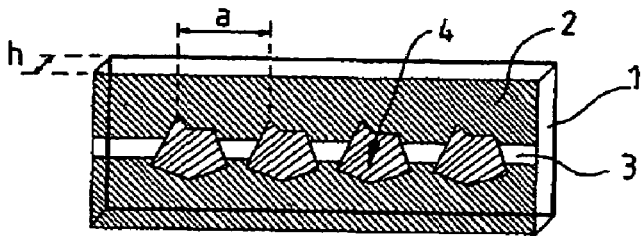
FIG. 1 is a schematic perspective view of a slot-type microwave device provided with a structure according to the present invention.

According to the present invention, the device is a printed circuit provided with a slot line. More precisely, the device comprises a substrate 1, one face 2 of which has been metallized, a slot line 3 having been produced in the substrate 1 by etching the metal layer 2. As shown in FIG. 1, the substrate has a thickness h and is made of a known dielectric.

According to the method of the present invention, the PBG structure is obtained by producing patterns 4 periodically on the opposite side of the substrate 1 from that bearing the metal layer 2. The patterns 4 are produced by etching a metal layer, giving metal patterns 4. Preferably, the patterns 4 are etched beneath the slot line 3.

To obtain the photonic bandgap structure, the patterns 4 are spaced apart by a distance a, which gives the repeat period of the patterns, this distance fixing the central frequency of the bandgap when the patterns are identical. The distance a is therefore about $k\lambda g/2$ where $\lambda g$ is the wavelength of the wave guided in the slot 3 at the central frequency of the chosen bandgap and k is an integer.

Figure 4:
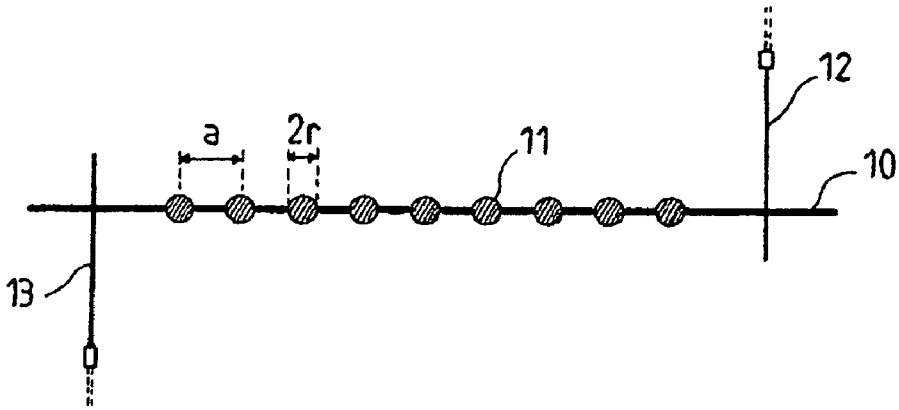
FIG. 4 is a schematic view of a photonic bandgap structure used for testing one embodiment of the present invention.

As shown in FIG. 4, the patterns are of any shape. However, the equivalent area of the patterns determines the width or the depth of the bandgap.

Figure 2A:
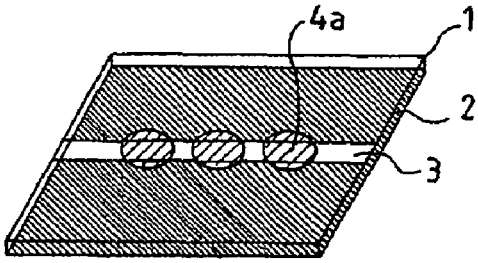
FIGS. 2A, 2B, 2C and 2D represent, schematically, various perspective views of a slot-type microwave device provided with a photonic bandgap structure in which the patterns have different shapes.
Figure 2B:
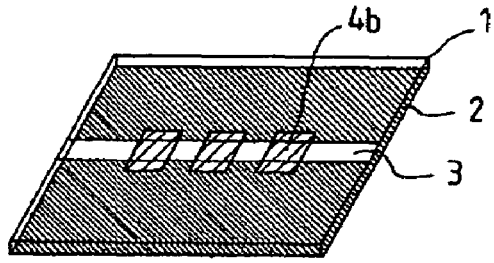
Figure 2C:
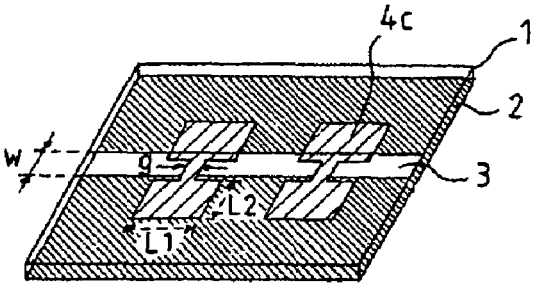
Figure 2D:
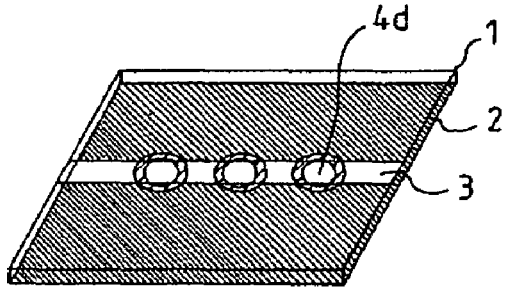

As shown in FIGS. 2A to 2D, the patterns used may be disc-shaped patterns 4*a*, as shown in FIG. 2A, rectangular or square patterns 4*b*, as shown in FIG. 2B, substantially H-shaped patterns allowing several parameters, such as the dimensions L1, L2 and g, namely a shape having three degrees of freedom, as shown by the patterns 4*c* in FIG. 2C, or ring-shaped patterns 4*d*, as shown in FIG. 2D. As will demonstrated later, the dimensions of each pattern, especially its equivalent area, allow the width or the depth of the bandgap to be adjusted.

Figure 3A:
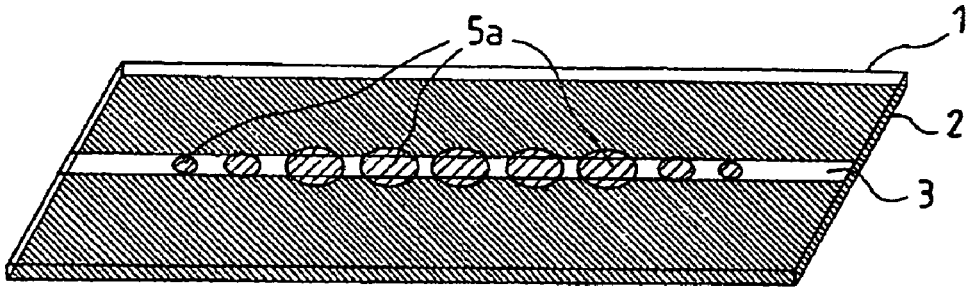
FIGS. 3A and 3B show embodiments in which the area of the patterns follows one particular law.
Figure 3B:
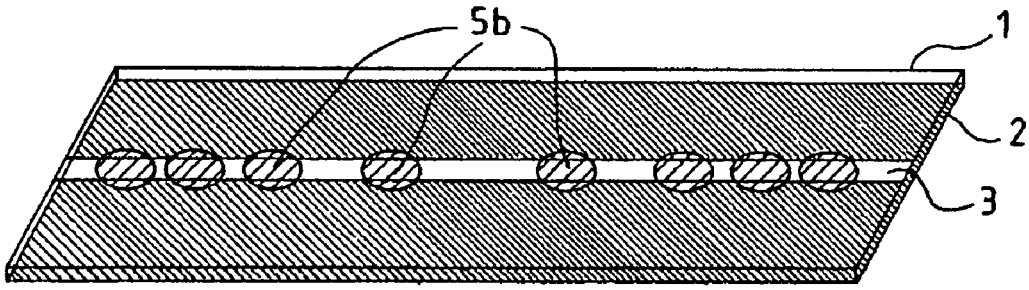

Moreover, as shown in FIGS. 3A and 3B, a structure according to the present invention may be obtained using disc-shaped patterns whose radius progressively varies, while still maintaining a constant inter-disc spacing equal to a. The variation may follow a defined mathematical law, such as a law of the Hamming window, Bartlett window or Kaiser window type. Moreover, as shown in FIG. 3B, the inter-disc spacing may also be progressively modified.

In addition, the structures described above may be combined, in particular in order to widen the bandgap. Thus, it is possible to place two structures of the type shown in FIG. 4 in cascade, one with a spacing a and disc-shaped patterns of radius r, the other with a spacing a' and disc-shaped patterns of radius r'. In this case, the central frequency corresponds to the centre of the frequency band defined by the minimum frequency of the PBG structure having the lowest central frequency and by the maximum frequency of the PBG structure having the highest central frequency.

The use of the PBG structure according to the invention, in slot antennas, in order to filter out certain frequencies, namely to produce a band-stop filter, will now be described more particularly with reference to FIGS. 4 to 7.

As shown in FIG. 4, the filtering effect has been demonstrated by simulating a slot line 10 in which discs 11 have been metallized, these discs being produced in a periodic pattern with a period a such that $a=\lambda g/2$, $\lambda g$ being defined as above, and the disc having a radius r.

Figure 5A:
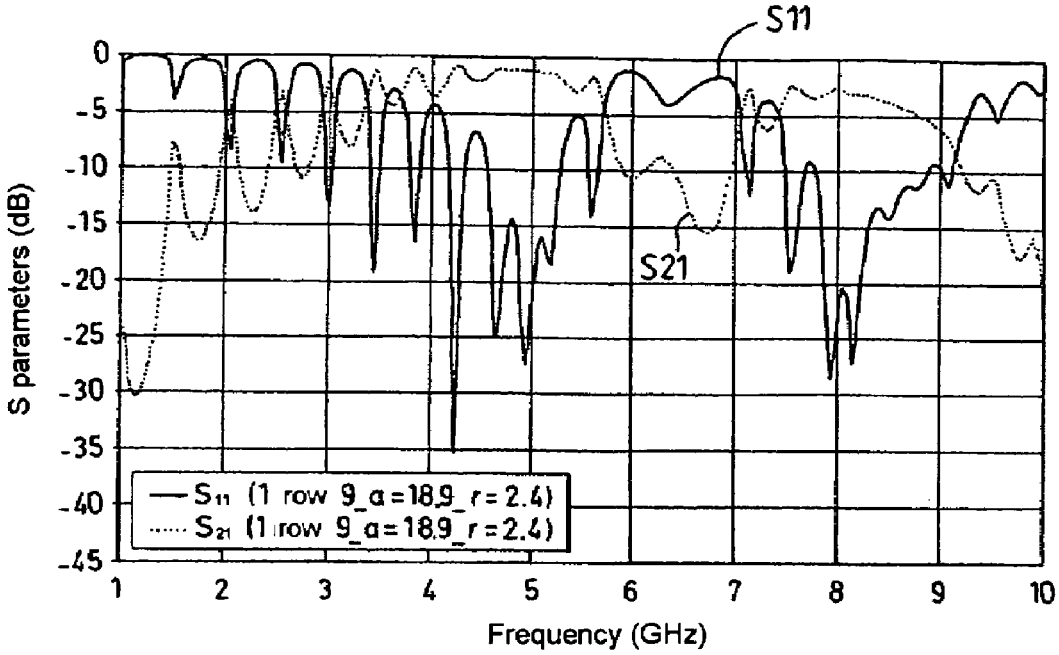
FIGS. 5A and 5B are curves that compare the reflection and transmission coefficients of a slot-line transition having a photonic bandgap structure with a conventional slot-line transition.
Figure 5B:
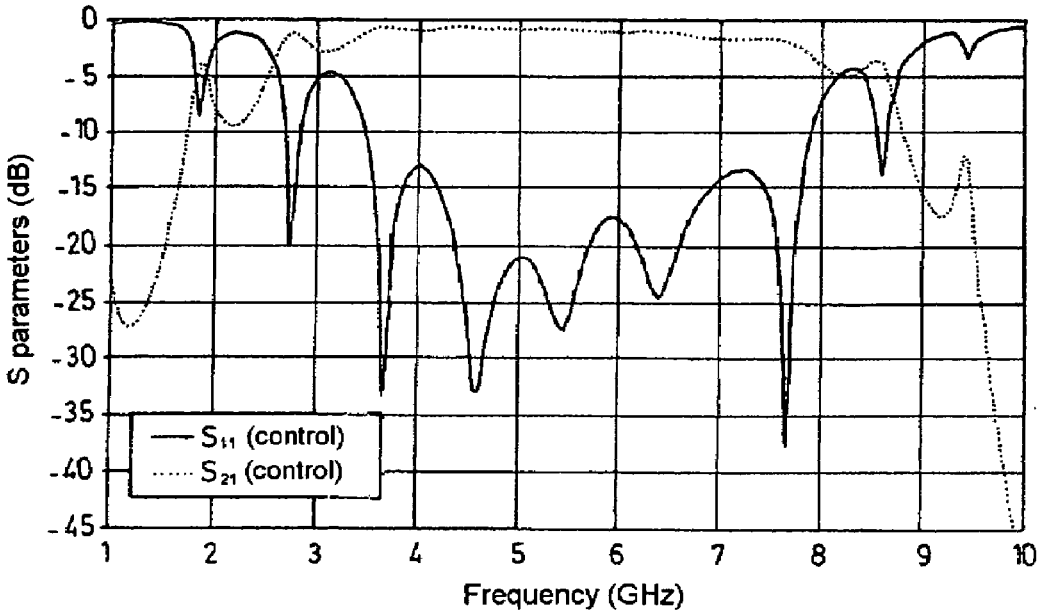

The slot-line has been simulated as being excited by two slot-line transitions 12 and 13, at each end of the slot 10. The slot line has been designed using the laws established by Knorr, and in the case of the present invention the following dimensions have been used: a=18.9 mm, r=2.4 mm and n=9. The results of the simulation, which are shown in FIG. 5A, demonstrate the opening of a bandgap having a width of around 1 GHz about the 6.5 GHz frequency. When the results shown in FIG. 5A are compared with those obtained for a slot-line without a photonic bandgap structure, as shown in FIG. 5B, it may be seen that what is created is a band-stop filter around 6.5 GHz.

Figure 6:
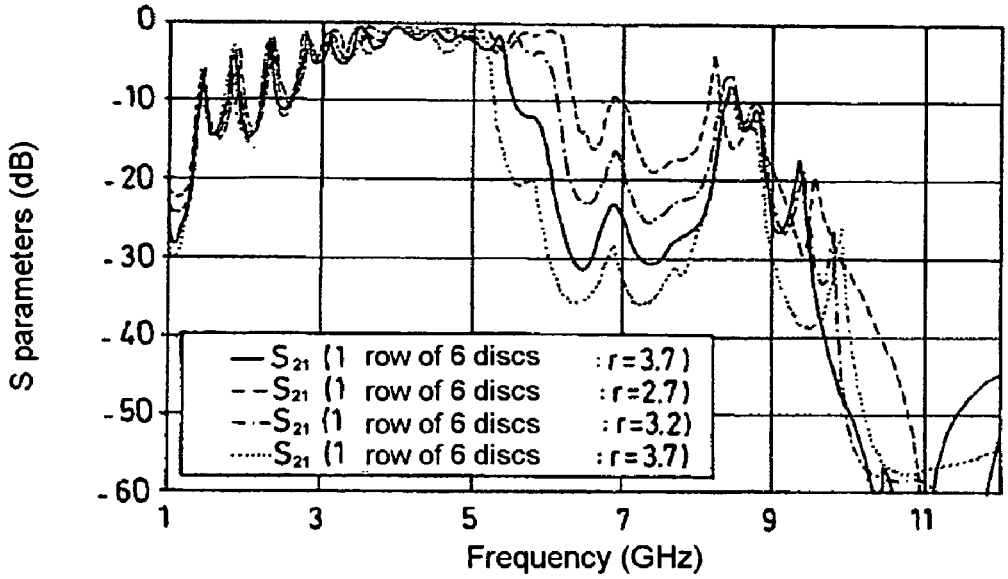
FIG. 6 is a curve giving the transmission coefficient in the case of a photonic bandgap structure consisting of discs, as illustrated in FIG. 4, showing the influence of the radius of the discs on the bandgap.

Starting from the same structure, discs having different radii were simulated and the results obtained are shown in FIG. 6 in the case of a photonic structure comprising six discs with radii r varying between 2.7 mm and 4.2 mm. It may be seen that the area of the disc modifies the width and the depth of the transmission coefficient of the photonic bandgaps.

Figure 7:
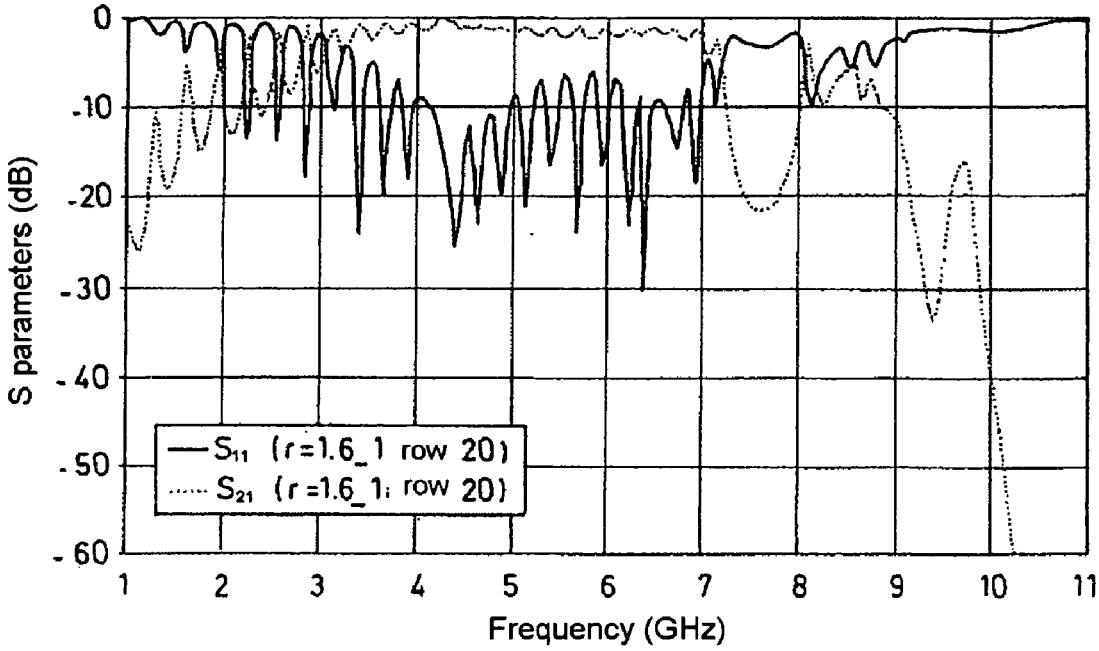
FIG. 7 is a curve giving the transmission and reflection coefficients in the case in which the photonic bandgap structure has been designed to reduce the size of the bandgap.

FIG. 7 shows the reflection coefficient of a structure such as that in FIG. 4, with PBG structures formed by twenty discs 1.6 mm in radius with a spacing a of 14.7 mm. In this case it may be seen that there is a narrow, 700 MHz, bandgap around the 7.5 GHz frequency.

Based on the various simulation results, it is therefore possible to determine the design of a PBG structure formed by metal discs capable of having a photonic bandgap centred on a desired frequency. Thus, let a be the repeat period of the PBG pattern and let $\lambda_{bg}$ be the wavelength corresponding to the central frequency of the desired bandgap, then the period may be obtained using the following equation:

$$a=\lambda_{bg}/2\sqrt{\epsilon_{eff}}$$

where $\epsilon_{eff}$ represents the effective permittivity of the substrate.

Next, it may be seen that the radius r of the discs influences the width and the depth of the transmission coefficient of the bandgap. A significant bandgap ($S_{21}$ of around −20 dB) is obtained for a value such that $0.15<r/a<0.25$.

This was demonstrated in the figures given above.

Various slot antenna structures provided with PBG structures obtained using the method described above, for carrying out filtering functions, will now be described with reference to FIGS. 8 to 17.

Thus, FIGS. 8 to 12 show a PBG structure produced beneath an antenna of the closed slot type, the antenna being fed via a feed line, more particularly a line of the microstrip line type, at a slot-line transition using the known Knorr laws.

Figure 8:
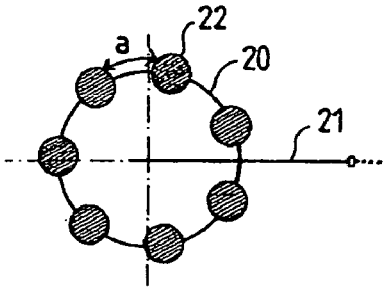
FIG. 8 shows schematically an annular slot antenna provided with a photonic bandgap structure, in one way of using the method of the present invention.

FIG. 8 shows very schematically an annular slot 20. This slot was produced by etching an earth plane on a substrate (not shown). This annular slot 20 is fed via a microstrip line 21, the assembly being designed in a known manner for operation at a given frequency $F_0$. In this case, the antenna exhibits resonances at every odd multiple of the frequency $F_0$.

A PBG structure formed by metallized discs 22 periodically beneath the annular slot was produced according to the present invention. This PBG structure 22 is designed so as to filter out harmonics obtained in the case of a conventional annular slot antenna.

Thus, the periodicity a between two patterns 22 was calculated so as to have a bandgap frequency corresponding, for example, to the 3rd-order harmonic. To give an example, for operation at $f_0$=2.4 GHz, the radius of the annular slot 20 is r=5.4 mm and the length of the microstrip line 21 is 20 mm.

Figure 9:
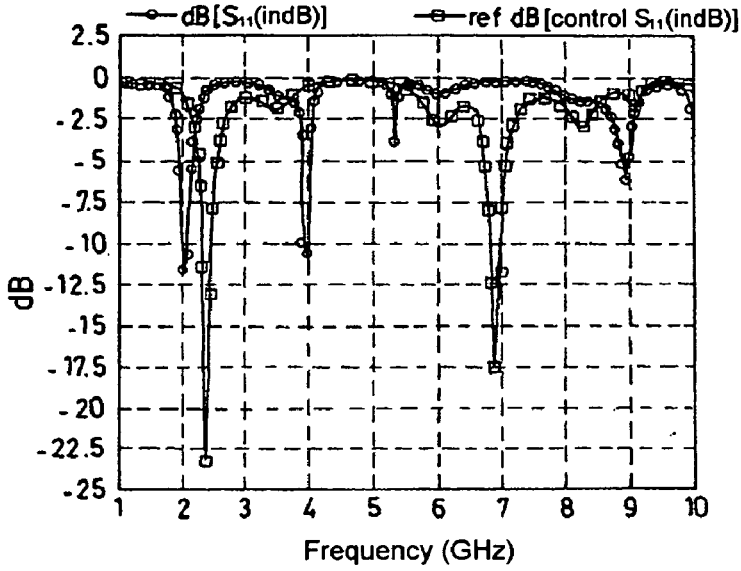
FIG. 9 shows a curve giving the reflection coefficient of the antenna shown in FIG. 8, compared with a conventional annular slot antenna.
Figure 10:
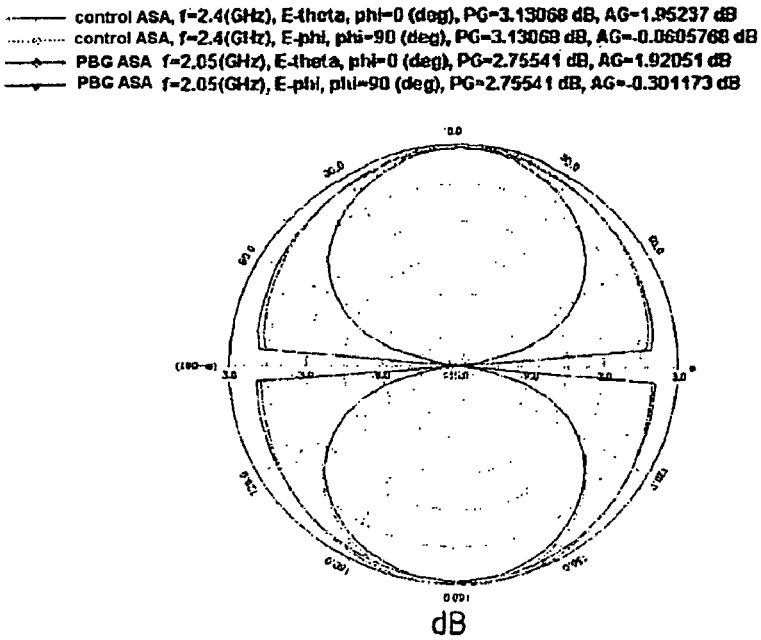
FIG. 10 shows the main radiation components of the antenna in the case of an annular slot antenna, comparing the case of an antenna having a photonic bandgap structure with a conventional antenna.

As shown in FIG. 9, parasitic resonances are obtained at around 7 GHz, i.e. substantially at a value of $3f_0$, while the reflection coefficient curve is substantially flat in the region around 5 GHz. This slot antenna is provided with a PBG structure, the dimensions of which were calculated using the rules given above for the discs. Inter-disc periodicity a of 14.7 mm and a disc radius of 3.7 mm are therefore obtained so as to eliminate the resonant frequency at around 7 GHz. This is shown in FIG. 9 by the curve provided with points. With the two types of antenna, and as shown in FIG. 10, what is obtained is a substantially similar omnidirectional radiation pattern. This also follows from Table A below, which gives the efficiency of the radiation and the efficiency of the antenna for both cases.

TABLE A

| | ASA* 2.4 GHZ | ASA* with PBG 2.05 GHz |
|---|---|---|
| Radiation efficiency (%) | 93.6 | 92.8 |
| Antenna efficiency (%) | 93.1 | 86 |

*ASA = Annular Slot Antenna

According to a variant of the invention, a PBG structure of the same type can be used within its bandwidth. In this case, the PBG structure is designed to have a bandgap at a higher frequency than the desired operating frequency. The PBG structure is the source of what is called a "slow wave" effect within its bandwidth: the phase of the transmission coefficient of a wave along a slot line is modified by the presence of the metal discs beneath this line. The velocity of propagation of the line beneath the slot is then slowed (i.e. the slow-wave effect). It is therefore possible to propose a PBG structure in which the equivalent electrical length of the slot is modified. In other words, the presence of the PBG structure makes it possible to reduce the wavelength of the wave guided in the slot:

$$(\lambda_g)_{BPG}<\lambda_g<\lambda_0,$$

$(\lambda_g)_{BPG}$ is the wavelength of the wave guided in the slot in the presence of the PBG structure, $\lambda_g$ is the wavelength of the wave guided in the slot and $\lambda_0$ is the wavelength of the wave guided in vacuo.

Thus, an annular slot antenna designed for 2.4 GHz operates in an identical fashion when a PBG structure is present, but at a lower frequency (for example, 2 GHz).

Figure 11A:
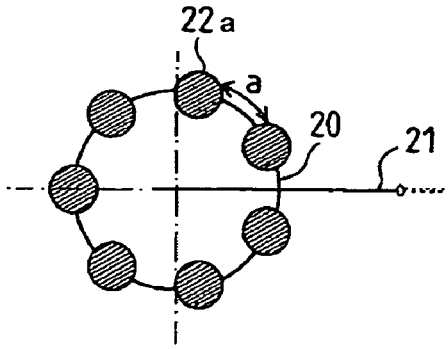
FIGS. 11A and 11B show various forms for the patterns of the photonic bandgap structure.
Figure 11B:
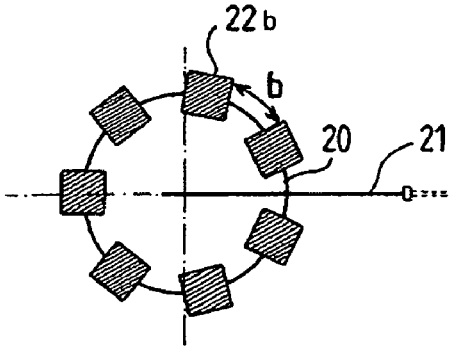

As shown in FIGS. 11A and 11B, the shape of the patterns 22*a* and 22*b* of the PBG structure may be different, for example circular and square, respectively. However, as results from curve 12*b*, if the area of the pattern 22*a* is equivalent to that of the area 22*b* and if the spacing a between two patterns is the same, substantially identical effects will be obtained, especially the elimination of the 3rd-order harmonic obtained with a conventional annular slot antenna, when the PBG structure operates as a filter.

Figure 12:
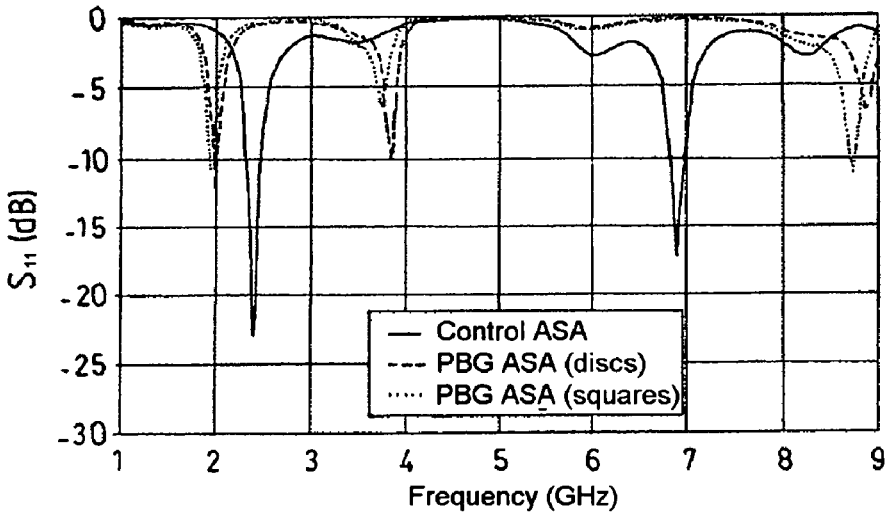
FIG. 12 is a curve giving the reflection coefficient of the antennas of FIGS. 11A and 11B, compared with a conventional annular slot antenna.

As the curves in FIG. 9 and FIG. 12 show, the use of a PBG structure beneath a slot antenna for eliminating the frequency of an odd harmonic may result in the creation of additional harmonics around twice the frequency (this is shown by a low amplitude peak at about 4 GHz).

To eliminate this type of harmonic, a conventional PBG structure, as described in the article mentioned in the introduction, may be used. In this case, patterns 23 are created beneath the feed line 21 produced in microstrip technology, by demetallizing the earth plane lying beneath the microstrip line.

In this case, slots are opened in the earth plane beneath the microstrip line.

Figure 13:
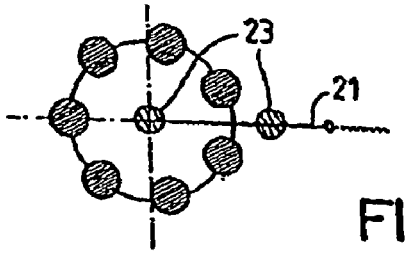
FIG. 13 is a schematic representation of an annular slot antenna provided with a PBG structure according to the present invention and fed via a microstrip feed line provided with a conventional PBG structure.
Figure 14:
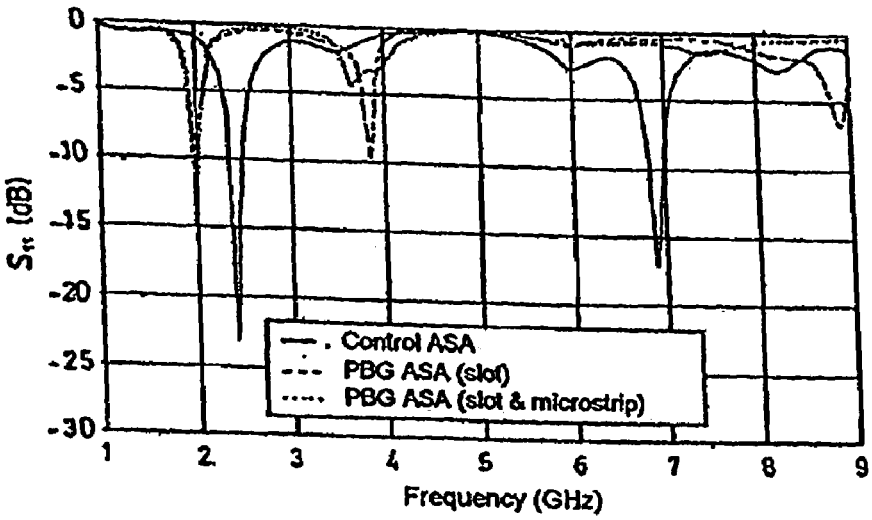
FIG. 14 is a curve giving the reflection coefficient as a function of frequency for the various annular slot antennas illustrated in the present invention.

The results obtained with such a structure are given by the curve in FIG. 14, which compares the reflection coefficient $S_{11}$ as a function of the frequency for various types of annular slot antenna, namely the control antenna, the antenna provided with a PBG structure according to the present invention, and the antenna of FIG. 13. In this case, a reduction in the amplitude of the peak at the 4 GHz frequency is observed.

Another embodiment of a PBG structure in the case of a Vivaldi slot antenna will now be described. The description will be given with reference to FIGS. 15 to 17.

Figure 15:
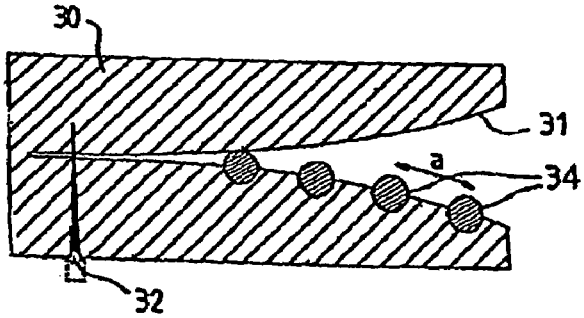
FIG. 15 is a schematic view of a Vivaldi antenna provided with a PBG structure according to another embodiment of the present invention.

As shown in FIG. 15, a Vivaldi antenna 31 was produced on a metallized substrate 30 by opening a slot, by demetallizing the surface 30, this slot having an outwardly tapering profile. This Vivaldi antenna is well known to those skilled in the art and will not be described in further detail. As is known, this antenna is fed via a feed line 32 according to the Knorr principle. This feed line 32 consists of a microstrip line.

According to the invention, a PBG structure formed by periodic patterns is etched on the opposite side of the substrate from that receiving the tapered slot 31, along at least one of the profiles constituting the Vivaldi antenna. As shown in FIG. 15, the PBG structure is formed from four discs 32 uniformly spaced by a distance a.

Figure 16:
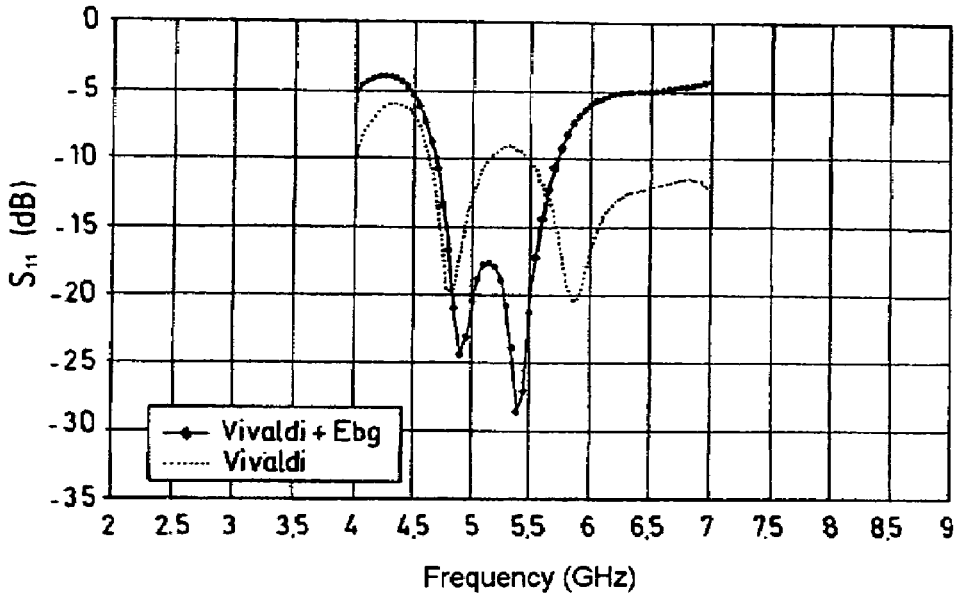
FIG. 16 is a curve giving the reflection coefficient as a function of frequency in the case of the Vivaldi antenna shown in FIG. 15, compared with a conventional Vivaldi antenna.
Figure 17A:
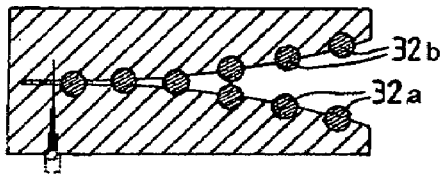
FIGS. 17A and 17B are schematic representations of two other embodiments of a Vivaldi antenna according to the present invention.
Figure 17B:
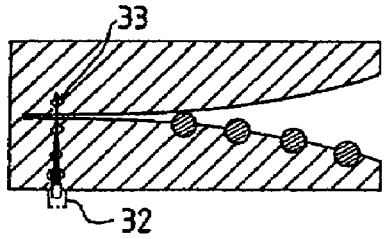

By using a PBG structure as shown in FIG. 15, it is possible to create, in a Vivaldi antenna, frequency bands in which wave propagation is forbidden. This is because the Vivaldi antenna operates intrinsically with a very broad band of frequencies, and the use of a PBG structure will make it possible to create one or more operating sub-bands. The structure shown in FIG. 15 was simulated on a Vivaldi antenna operating around a central frequency of 5.8 GHz and having a profile along a radius R=350 mm, a length L=99 mm and an opening X=30 mm. A Vivaldi antenna without the PBG structure has a 2 GHz bandwidth at 10 dB of between 5.5 and 7.5 GHz. If an antenna of this type is provided with a PBG structure designed to have a bandgap around 6.5 GHz, namely one formed from discs with a radius R=4.3 mm and with a period a=17.2 mm, the reflection coefficient as a function of frequency as shown in FIG. 16 is obtained. In this case, the operating band of the Vivaldi antenna is reduced by the addition of the PBG structure, which prevents the propagation of waves along the slot between 5.5 and 7 GHz. If it is desired to forbid two separate frequency bands, a PBG structure profile 32*a*, 32*b*, as shown in FIG. 17A, may be used. Moreover, the filtering may be enhanced by feeding the Vivaldi antenna via a feed line 32 provided with a conventional PBG structure 33, as described above in the case of an annular slot antenna.

It is obvious to a person skilled in the art that the embodiments described above have been given by way of example and that a PBG structure, obtained by the method according to the present invention, may be used in antennas other than slot antennas.

The invention claimed is:

1. Microwave antenna consisting of a closed slot produced on a first metallized face of a substrate, the slot being fed via a feed line and operating at a given frequency, including a filtering structure (PBG) consisting of metal elements produced on a second face of the substrate opposite the first face, said elements facing the slot being periodically spaced and having identical surface to form a photonic bandgap structure and determining a bandgap frequency.

2. Microwave antenna according to claim 1, wherein the periodicity of the elements of the PBG structure is chosen so that the bandgap frequency is equal to one of the harmonics of the operating frequency of the closed slot.

3. Microwave antenna according to claim 1, wherein the periodicity of the elements of the PBG structure is chosen so that the bandgap frequency is greater than the operating frequency of the closed slot.

4. Microwave antenna according to claim 1, wherein the closed slot is an annular slot.

5. Microwave antenna according to claim 1, wherein the slot is fed through a slot-line transition via a feed line produced in microstrip technology.

6. Antenna according to claim 5, wherein an additional photonic bandgap structure is produced beneath the feed line in microstrip technology by demetallizing the face of the substrate opposite that receiving the feed line.

7. A Vivaldi microwave antenna, formed by a tapered slot including a filtering structure (PBG) consisting of metal elements produced on a second face of the substrate opposite the first face, said elements facing the slot being periodically spaced and having identical surface to form a photonic bandgap structure determining a bandgap frequency.

8. Antenna according to claim 7, wherein the photonic bandgap structure is produced along at least one of the profiles of the tapered slot constituting the Vivaldi antenna.

9. Antenna according claim 7, wherein the Vivaldi antenna is fed through a slot-line transition via a feed line produced in microstrip technology.

10. Antenna according to claim 9, wherein an additional photonic bandgap structure is produced beneath the feed line by demetallizing of the face of the substrate opposite that receiving the line.

11. A filtering structure on a microwave device formed by a slot produced on a first metallized face of a substrate, said structure comprising metal elements on a second face of the substrate opposite the first face receiving the slot, said elements facing the slot being periodically spaced and having identical surface to form a photonic bandgap structure determining a bandgap frequency.

12. Structure according to claim 11, wherein the periodicity between two elements is equal to $k\lambda g/2$ where $\lambda g$ is the wavelength of the wave guided in the slot at the chosen bandgap frequency and k is an integer.

13. Structure according to claim 11, wherein the bandgap frequency has a width and a depth depending on the equivalent area of the periodic elements.

14. Structure according to claim 11, wherein the elements are formed from discs, squares, rings or H shaped elements.

* * * * *